United States Patent [19]

Cooley

[11] 4,370,192

[45] Jan. 25, 1983

[54] APPARATUS FOR CHEMICAL ETCHING OF SILICON

[75] Inventor: Richard F. Cooley, Campbell, Calif.

[73] Assignee: American Microsystems, Inc., Santa Clara, Calif.

[21] Appl. No.: 198,567

[22] Filed: Oct. 20, 1980

[51] Int. Cl.[3] ..... C23F 1/02; F25B 19/00; H01L 21/306

[52] U.S. Cl. ..... 156/345; 62/514 R; 134/57 R; 156/630; 156/631; 156/637; 156/645; 156/657; 252/79.3; 252/79.4

[58] Field of Search ..... 156/345, 630, 631, 633, 156/637, 645, 657, 662; 134/57 R, 105, 107; 62/50, 514 R; 252/79.3, 79.4

[56] References Cited

U.S. PATENT DOCUMENTS

| | | | |
|---|---|---|---|
| 3,127,755 | 4/1964 | Hemery | 62/514 R X |
| 3,959,982 | 6/1976 | Denis et al. | 62/514 R X |
| 4,251,317 | 2/1981 | Foote | 156/345 X |

*Primary Examiner*—William A. Powell
*Assistant Examiner*—Thomas Bokan
*Attorney, Agent, or Firm*—Alan H. MacPherson; Steven F. Caserza; Richard Franklin

[57] ABSTRACT

Extremely cold gaseous nitrogen is used as a cooling medium in the highly exothermic reaction between a chemical etch solution and silicon. This greatly increases the throughput of silicon material through the etchant over prior art techniques, particularly where it is desired to maintain the temperature of the etchant solution below 25° C.

19 Claims, 6 Drawing Figures

APPARATUS FOR CHEMICAL ETCHING OF SILICON

BACKGROUND OF THE INVENTION

1. Field of the Invention

This invention relates to a method and an apparatus useful in the chemical etching of silicon.

2. Description of the Prior Art

Methods for physical abrasion and chemical etching of silicon are well-known in the prior art. During the manufacture of silicon semiconductor devices, silicon wafers are put through a variety of chemical processes. These processes form the desired electronic circuits on the front side 1 of the silicon wafer 2 of FIG. 1. At the same time, on the backside of the wafer an undesired semiconductor diode junction 5 is formed, as well as an undesired non-uniform oxide layer 3. Oxide layer 3 is then ground off in a back-lap process to expose bare silicon on the back surface 4 of wafer 2. By exposing bare silicon on the back surface 4, improved electrical contact can be made to back surface 4. In addition, an improved surface is made available for attaching individual dice contained on wafer 2 to a package or substrate. Back-lap is also performed to control the thickness of finished wafer 2.

During the back-lap process, a large amount of silicon debris is formed on back surface 4 of wafer 2. This debris must be removed in order to realize the benefits for which the back-lap operation was performed. Several different methods of removing this debris are used. Various washes, including ultrasonic baths, have been used in the prior art. Acid etches have also been used in the prior art to remove this debris, as well as for other purposes, including the preparation of the back side of the wafer for deposition of metal.

Back-lapping also creates a stress layer on the back side of the wafer due to the abrasion. This stress layer, containing many stress multipliers, promotes the destruction of semiconductor dice contained on the wafer due to cracking. This problem is aggravated by the high temperatures used to attach the die to a package or a substrate, and the stress generated due to different coefficients of expansion of the die and the package or substrate during temperature changes. Chemical etching can also be used to remove this stress layer from the back side of the wafer.

Perhaps the most generally preferred method of etching silicon is the use of an etchant solution containing hydrofluoric, acetic, and nitric acids. Such a method is described in "Chemical Etching of Silicon", by Schwartz & Robbins, which appeared in the *Journal of Electrochemical Society: Solid State Science & Technology*, December 1976, page 1903. This three-acid system provides a two-step etch. The nitric acid oxidizes silicon to silicon dioxide, and the hydrofluoric acid dissolves the silicon dioxide from the surface of the wafer. The rate of reaction (etch rate) increases with increased temperature and increased agitation. The etch rate is also dependent on the precise composition of the etchant solution, as has been widely reported in the literature, and the amount of dissolved silicon in the solution.

During the back-lap process, means of protecting the electronic circuitry formed on the front side of the wafer is required. One prior art method is shown in FIG. 2. Wafers 71 are cemented to backing plate 70 utilizing a special wax. Backing plate 70, together with the wax, protects circuits formed on the front side of the wafer, while allowing the back surface of wafer 71 to remain exposed during the back-lap and chemical etching operations. A second prior art technique of protecting circuits formed on the front side of a semiconductor wafer is through the use of a plastic tape, such as "Etching Discs" manufactured by the Cellotape Company of Sunnyvale, California. This tape contains an adhesive, which allows the tape to be firmly affixed to the front side of a wafer to be protected. This plastic tape is impervious to the acids used to etch silicon; therefor, it is also used to protect circuits formed on the front side of the wafer during acid etches of the back side of the wafer.

A major disadvantage of using a backing plate to protect the front side of the wafer during back-lap and etching is that its use is rather time consuming. Furthermore, due to the size of the backing plate, relatively few wafers may be etched in an acid bath of any given size. A disadvantage with the tape method of protecting circuitry contained on the front side of a wafer during etching is that the adhesive holding the tape to the front surface of the wafer is functional in acid baths only at rather low temperatures. For best results, the acid bath should be maintained below 20° C. in order to ensure that the tape will function. Both of these prior art methods severely limit the throughput of wafers at the etch operation. Typically, only about 7 wafers are etched at once in a prior art system containing approximately 15 gallons of etchant.

One problem with the prior art etching process is that it generates heat thereby raising the temperature of the etching solution. When this temperature rises above 20° C., the tape used to protect the previously formed circuitry on the front of the wafer becomes less effective thereby reducing the number of good dice obtained from the wafer.

An experimental value was calculated for the heat of solution of silicon in an etching solution containing acetic, nitric and hydrofluoric acids. This heat of solution was found to be approximately 21 kilocalories per gram of silicon dissolved in the etchant. This very high heat of solution is indicative of the fact that the reaction between the acid etch and silicon is highly exothermic, thereby causing a rapid increase in the temperature of the acidic etch solution and thus limiting the etch solution to use with wafers whose front side circuitry has been protected with plastic tape.

The heat removal rate from the etching system can be expressed as $$R = \frac{C_p M \Delta T}{t} \qquad \text{Eq. (1)}$$

where R = the heat removal rate, M/t = the mass flow of the heat transfer medium per unit time, $C_p$ = the heat capacity of the heat transfer medium, $\Delta T$ = the temperature change of the heat transfer medium from the entrance to the exit of the cooling coil or cooling chamber.

Prior art methods of removing this heat generated during the chemical etch of silicon had been primarily through the use of cooling jackets surrounding the etching solution, or cooling tubes immersed within the etching solution. An etchant tank having a cooling jacket surrounding the etchant is shown in FIG. 3. Etchant tank 25 is comprised of inner wall 18 and outer wall 17, thus forming cooling jacket 15. Inlet 20 and outlet 21 are connected to provide means for a coolant to enter and flow through cooling jacket 15, thus cooling the solution contained within region 19. In a similar fashion, a cooling coil may be constructed of material immersed in the etchant. The surface of the immersed cooling coil exposed to the etchant must be impervious to physical and chemical attack by the etchant. Materials such as stainless steel, titanium, or various plastics, such as Kynar, sold by the Penwalt Corporation, or Teflon, sold by Dupont, are suitable for this purpose.

Prior art methods of cooling silicon etching solutions are limited to utilizing water as the cooling medium, or utilizing a refrigerant, together with an external refrigeration apparatus. Such prior art coolants are rather expensive and inefficient in removing large quantities of heat so as to maintain the etching solution at the desired temperature of approximately 10° C., due to the relatively small temperature difference ($\Delta T$) between the chemical etch and the coolant.

SUMMARY OF THE INVENTION

This invention utilizes an extremely cold gas such as nitrogen as a cooling medium to remove from a chemical etchant the large amounts of heat generated during the highly exothermic chemical reaction between silicon and the etchant. The low temperature of the gas (approximately −190° C. when nitrogen is used) provides a much greater temperature difference between the coolant and the chemical etchant than coolants used in the prior art, thereby allowing much more effective heat removal.

DETAILED DESCRIPTION OF THE INVENTION

Figure 4:
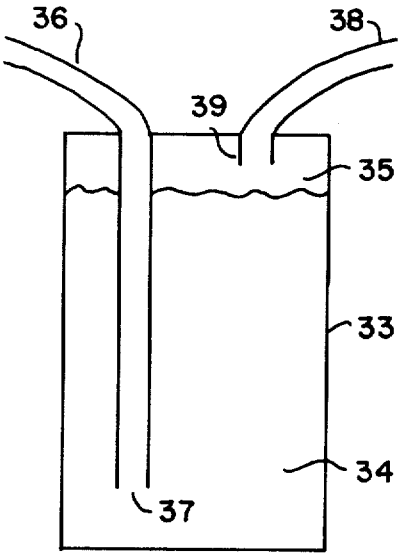
FIG. 4 is a cross-sectional view of a liquid nitrogen dewar.

One embodiment this invention utilizes liquid nitrogen, which is inexpensive and readily available at semiconductor manufacturing locations, as the source of the cooling medium for a silicon etching solution. Liquid nitrogen is commercially available in dewar flasks such as the liquid nitrogen dewar 33 shown schematically in FIG. 4. Liquid nitrogen 34 is located in the bottom of dewar 33, and gaseous nitrogen 35 is contained at the top. Nitrogen in gaseous form from an external, pressurized source is fed into inlet 36 and discharged at opening 37, below the surface of liquid nitrogen 34. This gaseous nitrogen causes liquid nitrogen 34 to evaporate, thus generating a steady supply of cold gaseous nitrogen 35, which leaves dewar 33 via vent 39 and is piped to the chemical etch tank via tube 38.

Figure 5:
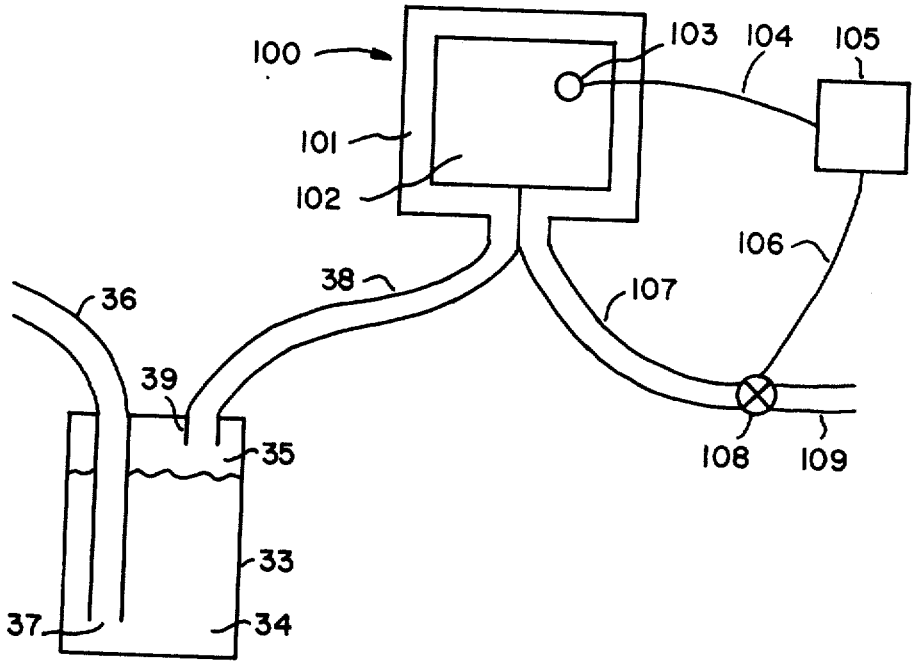
FIG. 5 is a cross-sectional view of one embodiment of this invention.

A diagram of a complete operating system is shown in FIG. 5. Etchant tank 100 contains cooling jacket 101 and etchant chamber 102 as shown. Liquid nitrogen dewar 33 contains cold nitrogen gas 35 and liquid nitrogen 34. A supply of gaseous nitrogen is connected to inlet 36, and exits below the surface of liquid nitrogen 34 at point 37. This results in a constant supply of cold gaseous nitrogen 35 being available at port 39 which is connected to cooling jacket 101 via line 38. The exit line 107 from cooling jacket 100 is connected to solenoid valve 108. Solenoid valve 108 is controlled via lead 106 connected to temperature controller 105 of well-known design. Temperature sensor 103 is connected to temperature controller 105 via lead 104. When the temperature of the etchant contained within etchant chamber 102 rises above a predetermined value, as sensed by temperature sensor 103, temperature controller 105 generates a signal, transmitted along line 106, which causes solenoid valve 108 to open. With solenoid valve 108 open, gaseous nitrogen is caused to flow through cooling jacket 100 from inlet 38 to outlet 109, into the atmosphere. As cool gaseous nitrogen 35 flows through line 38, and through cooling jacket 100, it absorbs heat from the chemical etch solution contained within etchant chamber 102, thus preventing the temperature of the chemical etchant from rising above a desired value.

Figure 6:
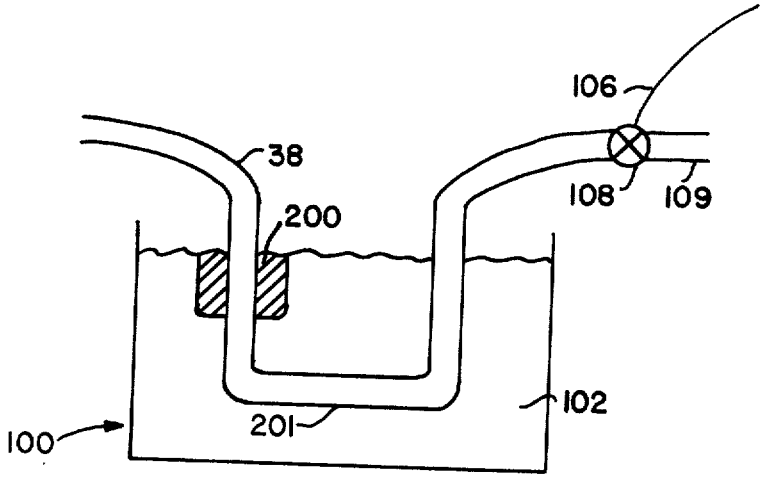
FIG. 6 is a cross-sectional view of a second embodiment of this invention.

A second embodiment of this invention is shown in FIG. 6. Here, a cooling coil 201 is immersed in etchant solution contained within etchant tank 100. Inlet 38 of cooling coil 201 is connected to a source of cold gaseous nitrogen (not shown). The discharge end of cooling coil 201 is connected to outlet 109 through solenoid valve 108. Electrical lead 106 is used to control solenoid valve 108 by transmitting a signal from a temperature control system (not shown). Insulation material 200 is used to protect the relatively brittle protective plastic coating on cooling coil 201 (or the cooling coil 201 itself, if constructed solely of plastic material) by preventing the plastic from reaching the extremely low temperature of the cooling gas, thereby becoming brittle and fracturing. Of course, for systems utilizing a metallic cooling coil 201 which is impervious to the chemical etchant, such as stainless steel, insulation 200 is not required.

During experimentation conducted with the apparatus of this invention, 50 four inch wafers were etched in a period of 6.25 minutes, resulting in the removal of approximately 21.9 grams of silicon. This caused the generation of approximately 459 Kcals of heat, assuming a heat of solution of 21 Kcals/gram of silicon, or approximately 73 Kcals/minute. Using extremely cold gaseous nitrogen having a temperature of approximately −190° C., and an exit temperature of approximately 10° C. from the cooling coil, a $\Delta T$ of approximately 200° C. is achieved. With a heat capacity of nitrogen of approximately 0.249 cal/gm° C., this requires an average $N_2$ flow of:

$$\frac{73\ \text{Kcals/min}}{(0.249\ \text{cal/gm °C.})(200°\ \text{C.})} = 1466\ \text{gm/min}$$

which is equivalent to, assuming approximately 1.2 grams/liter of $N_2$ at 10° C., $$\frac{1466\ \text{gm/min}}{1.2\ \text{gm/liter}} = 1222\ \text{liters/min.}$$

This required average flow rate is easily maintained utilizing the principles of this invention.

The average flow rate of coolant gas may be calculated by the following equation:

$$F = \frac{Q_s M}{t Q_c \Delta T P}$$

where

F = average flow rate of coolant gas at vent, in liters/-min $Q_s$ = Heat of solution, in calories/gm of material etched M = mass of material etched, in grams t = time of reaction $Q_c$ = Heat capacity of coolant gas, in calories/gram° C.

P = density of coolant gas, at vent, in grams/liter

Figure 1:
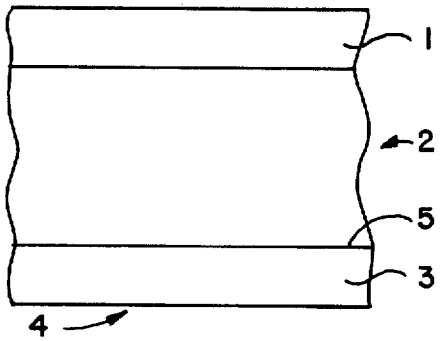
FIG. 1 is a side view of a portion of a silicon wafer.
Figure 2:
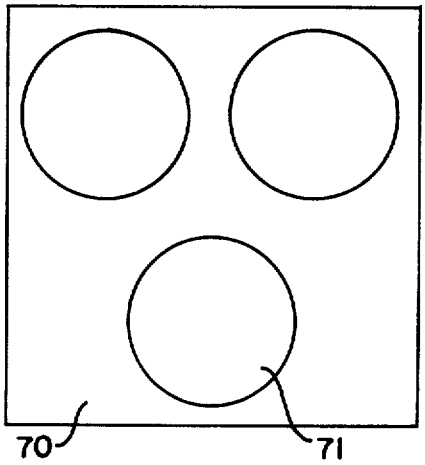
FIG. 2 is a top view of a prior art backing plate used to protect the front surface of silicon wafers during chemical etching.
Figure 3:
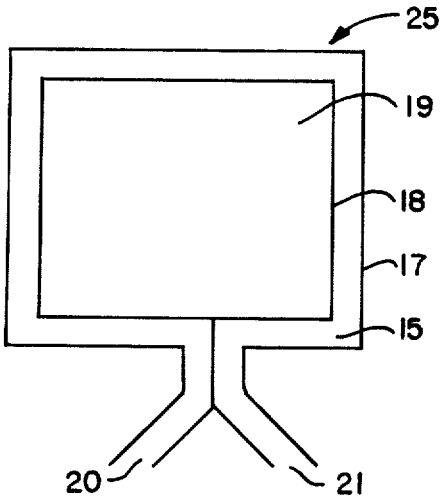
FIG. 3 is cross-sectional view of a chemical etchant tank containing a cooling jacket.

In a third preferred embodiment of this invention, liquified coolant is introduced into cooling jacket 15 of FIG. 3 or cooling coil 201 of FIG. 6. This liquified coolant is evaporated within cooling jacket 15 or cooling coil 201. The evaporation and subsequent warming of the cooling gas within cooling jacket 15 or cooling coil 201 removes heat from the chemical etch solution contained within region 19 of FIG. 3 or within etchant tank 100 of FIG. 6, thus preventing the temperature of the chemical etchant from rising above a desired value.

Thus, this invention provides an improved method of removing heat generated in the highly exothermic chemical reactions utilized to etch silicon. This invention utilizes extremely cold gaseous nitrogen, formed from liquid nitrogen, as the cooling medium. This has the advantage of providing a much greater temperature differential between the cooling medium and the solution to be cooled, as well as being very inexpensive and readily available. Prior art methods allow etching of only 7-10 wafers at one time in 15 gallons of etchant. Utilizing this invention, at least forty to fifty 4 inch diameter wafers may be etched at one time in a tank containing approximately 4 gallons of etchant solution, while maintaining the etchant solution temperature below 20° C., thus preventing loss of adhesion of protective plastic tape on the front side of the wafer. This method allows the etching of approximately 50 grams of silicon within approximately 10 minutes. A portion of the cooling gas may be bubbled through the etching solution to provide agitation.

While reference has been made to nitrogen as the cooling gas, any other gas having a temperature below the chemical etch to be cooled may be used. Naturally, the smaller the temperature difference between the etchant and the cooling gas, the greater the required flow rate of the cooling gas. Similarly, while reference has been made to the acidic etching of silicon using hyrdofluoric, nitric and acetic acids, the system of this invention can be used for the removal of heat from any chemical solution. Also, the solenoid valve is just one example of a device used to control the coolant gas flow; any device capable of controlling the flow of coolant gas may be used without detracting from the spirit of this invention.

I claim:

1. Structure for holding an etchant for use in etching semiconductor wafers containing on one surface thereof masking material to protect circuitry formed adjacent said one surface from said etchant comprising:

an etchant tank having an inner wall and an outer wall, for containing an etchant for use in etching a material in an exothermic reaction, thereby forming a cooling jacket within said inner and outer walls, said cooling jacket having an inlet and an outlet;

a source of coolant gas connected to said inlet of said cooling jacket;

temperature detection means for providing a signal indicative of the temperature of said etchant;

a vent connected to said outlet; and control means responsive to said signal indicative of the temperature for controlling the flow of said coolant gas through said cooling jacket;

whereby said coolant gas removes heat generated in the exothermic reaction between said etchant and the material being etched at a rate selected to maintain the temperature of said etchant beneath a selected value wherein said selected value is selected to ensure that said etchant is maintained at a temperature sufficiently low to prevent masking material protecting circuitry from becoming less effective as a mask.

2. Structure for holding an etchant for use in etching semiconductor wafers comprising:

an etchant tank for containing an etchant;

a cooling coil located within said etchant tank, said cooling coil having an inlet and an outlet;

a source of coolant gas connected to said inlet of said cooling coil;

temperature detection means for providing a signal indicative of the temperature of said etchant;

a vent connected to said outlet; and control means responsive to said signal from said temperature detection means for controlling the flow of said coolant gas through said cooling coil;

whereby said flow of said coolant gas through said cooling coil serves to remove heat generated in the reaction between said etchant and the material being etched thereby to ensure that said etchant is maintained at a temperature sufficiently low to prevent masking material on one surface of said wafers from being removed.

3. Structure as in claim 1 wherein said source of coolant gas is liquified coolant which is injected into said inlet of said cooling jacket, whereby the evaporation of said liquified coolant takes place within said cooling jacket, and said evaporation and the heating of said coolant gas within said cooling jacket removes heat generated in the exothermic reaction between said etchant and the material being etched.

4. Structure as in claim 2 wherein said source of coolant gas is liquified coolant which is injected into said inlet of said cooling coil, whereby the evaporation of said liquified coolant takes place within said cooling coil, and said evaporation and the heating of said coolant gas within said cooling coil removes heat generated in the exothermic reaction between said etchant and the material being etched.

5. Structure as in claims 1, 2, 3 or 4 wherein said tank contains an etchant comprised of acetic, nitric, and hydrofluoric acids.

6. Structure as in claims 1, 2, 3, or 4 wherein said source of coolant is nitrogen.

7. Structure as in claim 6 wherein said source of nitrogen is liquid nitrogen.

8. Structure as in claims 1, 2, 3 or 4 wherein said control means is connected between said source of coolant gas and said inlet.

9. Structure as in claims 1, 2, 3 or 4 wherein said control means is connected between said outlet and said vent.

10. Structure as in claims 1, 2, 3 or 4 wherein said control means is a solenoid valve.

11. Structure as in claim 5 wherein said control means operates to maintain the temperature of said etchant less than approximately 20° C.

12. Structure as in claim 11 wherein said control means operates to maintain the temperature of said etchant within the range of approximately 0° C.-20° C.

13. Structure as in claims 2 or 4 wherein said cooling coil is constructed of stainless steel.

14. Structure as in claims 2 or 4 wherein said cooling coil is constructed of titanium.

15. Structure as in claims 2 or 4 wherein said cooling coil is constructed of a plastic material substantially impervious to chemical or physical attack by said etchant.

16. Structure as in claims 2 or 4 wherein said cooling coil is coated with a plastic material substantially impervious to chemical or physical attack by said etchant.

17. Structure as in claim 16 wherein said inlet of said cooling coil is connected to said cooling coil below the top surface of said etchant, and said plastic material is insulated from said coolant gas by an insulating means, thereby preventing said plastic material from reaching the extremely low temperature of said coolant gas at said inlet.

18. Structure as in claims 1, 2, 3, or 4 wherein said tank contains an etchant and gas is bubbled through said etchant, thereby agitating said etchant.

19. Structure as in claim 18 wherein said gas is said coolant gas.

* * * * *